US007779612B2

(12) United States Patent
Fergusson et al.

(10) Patent No.: US 7,779,612 B2
(45) Date of Patent: Aug. 24, 2010

(54) PROCESS AND APPARATUS FOR FORMING A MINIMAL HEADSPACE POUCH

(75) Inventors: Stuart Fergusson, Kingston (CA); Larin Godfroy, Napanee (CA); Tony Reid, Bath (CA); Jim Sadler, Toronto (CA); David L. Schiele, Westerville, OH (US)

(73) Assignee: Liqui-Box Corporation, Worthington, OH (US)

( * ) Notice: Subject to any disclaimer, the term of this patent is extended or adjusted under 35 U.S.C. 154(b) by 40 days.

(21) Appl. No.: 12/074,571

(22) Filed: Mar. 5, 2008

(65) Prior Publication Data

US 2008/0209864 A1 Sep. 4, 2008

Related U.S. Application Data

(63) Continuation of application No. 11/810,207, filed on Jun. 5, 2007, now abandoned.

(60) Provisional application No. 60/811,042, filed on Jun. 5, 2006.

(51) Int. Cl.
*B65B 9/08* (2006.01)

(52) U.S. Cl. ..... 53/451; 53/551; 53/552

(58) Field of Classification Search ..... 53/433, 53/451, 374.8, 552, 52
See application file for complete search history.

(56) References Cited

U.S. PATENT DOCUMENTS 3,282,020 A * 11/1966 Smith ..... 53/551
3,849,965 A * 11/1974 Dominici ..... 53/451
4,215,520 A * 8/1980 Heinzer et al. ..... 53/173
4,563,862 A * 1/1986 McElvy ..... 53/552
4,656,818 A * 4/1987 Shimoyama et al. ..... 53/551
4,675,660 A 6/1987 Boscolo
4,765,186 A * 8/1988 Dieulesaint et al. ..... 73/290 V
4,947,621 A * 8/1990 Christine et al. ..... 53/451
4,964,259 A 10/1990 Ylvisaker et al.
4,999,974 A 3/1991 Kovacs et al.
5,083,550 A 1/1992 Krauss et al.
5,170,609 A * 12/1992 Bullock et al. ..... 53/434
5,231,817 A 8/1993 Sadler
5,241,804 A * 9/1993 Tsuruta et al. ..... 53/504
5,546,733 A * 8/1996 Paltrinieri ..... 53/503
5,711,136 A 1/1998 Carcano
5,930,983 A 8/1999 Terminella et al.

(Continued)

FOREIGN PATENT DOCUMENTS

EP 0289209 11/1988

(Continued)

*Primary Examiner*—Thanh K Truong

(57) ABSTRACT

A process for forming a pouch having an evacuated headspace containing a flowable material is disclosed. The process includes the steps of: providing a continuous tube of flexible and sealable film; supplying the continuous tube with a predetermined amount of flowable material; pinching the continuous tube above a sealing region so as to form a pinched portion of the continuous tube; evacuating the headspace between the pinched portion and the predetermined amount of flowable material; and sealing the continuous tube at the sealing region to form a top seal of a previously formed pouch containing flowable material and a bottom seal of a next-to-be filled pouch. Also disclosed is a vertical form-fill-seal apparatus for forming a pouch containing a flowable material and having an evacuated headspace.

41 Claims, 13 Drawing Sheets

U.S. PATENT DOCUMENTS

| | | | | |
|---|---|---|---|---|
| 6,138,442 | A * | 10/2000 | Howard et al. | 53/477 |
| 6,289,654 | B1 * | 9/2001 | Yamaguchi et al. | 53/434 |
| 6,543,206 | B2 | 4/2003 | Seward et al. | |
| 6,684,609 | B1 | 2/2004 | Bassissi et al. | |
| 6,735,928 | B2 * | 5/2004 | Kondo et al. | 53/508 |
| 6,990,790 | B2 * | 1/2006 | Yasuhira | 53/512 |
| 7,213,384 | B2 * | 5/2007 | Matheyka et al. | 53/374.6 |
| 7,546,722 | B2 * | 6/2009 | Tsuruta | 53/551 |
| 2002/0023410 | A1 | 2/2002 | Seaward et al. | |
| 2004/0241292 | A1 | 12/2004 | Geng et al. | |

FOREIGN PATENT DOCUMENTS

| | | |
|---|---|---|
| EP | 0381400 | 8/1990 |
| EP | 0681961 | 11/1995 |

* cited by examiner

PROCESS AND APPARATUS FOR FORMING A MINIMAL HEADSPACE POUCH

CROSS-REFERENCE TO RELATED APPLICATION

This application claims priority under 35 U.S.C. §119 from U.S. Utility Application Ser. No. 11/810,207, filed Jun. 5, 2007 (currently pending), which claims priority to Provisional Application Ser. No. 60/811,042, filed Jun. 5, 2006 (now expired). The entire contents of these applications are hereby incorporated by reference.

FIELD OF INVENTION

In one of its aspects, the present invention provides a process for forming a minimal headspace pouch containing a flowable material. In another of its aspects, the present invention provides an apparatus for forming a minimal headspace pouch containing a flowable material. In yet another of its aspects, the present invention provides a minimal headspace pouch formed by the process of the present invention.

BACKGROUND OF THE INVENTION

1. Field of the Invention

In one of its aspects, the present invention provides a process for forming a minimal headspace pouch containing a flowable material. In another of its aspects, the present invention provides an apparatus for forming a minimal headspace pouch containing a flowable material. In yet another of its aspects, the present invention provides a minimal headspace pouch formed by the process of the present invention.

2. Description of the Prior Art

Flexible Liquid Packaging is used to package many consumer goods, particularly food and beverages, which are often packaged in pouches formed of flexible materials. (The term "Liquid Packaging" is understood by those of skill in the art to refer to both liquids and other flowable materials, as explained further below.) Many products packaged in pouches are particularly sensitive to oxygen degradation. Many products particularly in the food industry require minimal air exposure to protect their flavour, colour, nutritive value, texture and shelf life. Oxygen reacts readily with many components of these products forming so-called "off-flavours" and "off-colours". Removal of oxygen from the packaging process of many foods allows for extended shelf life with no loss of flavour. In the case of film pouches, as a byproduct of certain preferred forming techniques, oxygen is commonly trapped in a headspace that is created above the product upon pouch formation.

Besides the advantages associated with minimizing oxygen exposure, for certain applications, minimal headspace is required to facilitate pouch insertion into a secondary container; a common packaging arrangement involves inserting a pouch in a cardboard box (the "bag-in-box" principle). A slack pouch is easier to insert into a box and will better form to shape than a puffy pouch (i.e. one with a large air-filled headspace).

Fill reliability or control is important in packaging. In fact, headspace is a common associated effect of techniques used to ensure fill reliability. In many jurisdictions, the advertised product quantity is mandated to be a minimum product quantity. Poor fill accuracy therefore requires that the fill level be set at above the posted product quantity, thereby raising costs. Consequently, while limiting headspace is important, it is also important to have reliable fill control. One known method for minimizing headspace involves filling a tube for making a pouch above the level of the top of the pouch and sealing through the product. This method can suffer from poor fill control. In addition, the product can interfere with seal formation.

Pouches made on vertical form-fill-seal machines are widely used in the Liquid Packaging industry. A typical vertical form-fill-seal machine includes a roll unwind, a forming section where film folds itself vertically, a vertical sealing section and a horizontal sealing section (sealing at the same time the top of a filled pouch and the bottom seal of the next pouch) and a chute and/or discharge conveyor system. At both the vertical and horizontal sealing sections, heat sealing jaws are generally employed to seal the film. Product is supplied through a supply conduit, generally a fill tube, delivering product in the continuous film tube created by the vertical sealing jaws. The vertical form-fill-seal method allows the efficient and effective packaging of foods and other products. Minimizing headspace in pouches made by this method would minimize oxygen degradation, and facilitate use of pouches made by this method in applications that require minimal headspace.

U.S. Pat. No. 5,038,550 to Wirsig et al. teaches a process and apparatus for improving vertical form-fill-seal machines, by minimizing the formation of tucks in the horizontal seals of pouches made on a vertical form-fill-seal machine. Minimizing tucking must be a consideration in any modification to a vertical form-fill-seal machine. In one embodiment, the invention includes a pair of transverse heat sealing jaws; a pair of spreader fingers adapted to be inside the tubular film and to shape the tubular film; and one or two pairs of detucker fingers adapted to act in unison with the transverse motion of the heat sealing jaws, to pinch a longitudinal edge of the tubular film and to urge the pinched tubular film transversely in a direction substantially parallel to the closing surfaces of the jaws and away from the other longitudinal edge of the tubular film.

Generally in operation the continuous film tube of vertical form-fill-seal machines is supplied with product from a product delivery system with continuous or intermittent flow through the supply conduit.

The delivery system may include a balance tank equipped with level control (float, ultrasonic, capacitance, etc.) and a supply conduit with a poppet valve for regulating flow. The machine may also include components for maintaining a constant level of product inside the continuous film tube. Typically, these components include a sensor for determining the level of the product inside the continuous film tube and a control device for controlling the poppet valve regulating the flow of product into the continuous film tube.

Known level sensors include a magnetic float housed inside the continuous film tube, the position of which can be determined by sensors positioned inside or outside the continuous film tube.

Other known sensors exploit the electrical conductivity of the product to create a circuit, whereby the values of electric quantities in the circuit, such as current flow, depend on the level of the product inside the continuous film tube.

U.S. Pat. No. 4,675,660 to Boscolo teaches a level sensor that involves creating energy waves inside a supply conduit using a transducer housed inside a packaging tube and contacting the conduit. The energy waves are transmitted to the product inside the packaging tube, which can then be detected and converted so as to indicate the level of the food product.

European patent 681 961 teaches a level sensor that includes a device for detecting temperature located outside a continuous packaging tube and comprising a number of temperature sensors located successively along the tube. The food product level inside the tube is determined based on the relationship between temperature sensors detecting a surface temperature of the tube affected by the food product, and temperature sensors detecting a surface temperature not affected by the food product.

U.S. Pat. No. 6,684,609 to Bassissi et al. teaches a vertical form-fill-seal machine that has a capacitive level sensor. The capacitive level sensor is positioned outside the continuous film tube facing an end portion of the fill conduit. The sensor and the fill conduit define a capacitive element, whose capacitance depends at least in part on the amount of food product therebetween.

Various methods for reducing headspace in packages are known.

U.S. Pat. No. 6,543,206 to Seward et al. teaches an apparatus and method for evacuating and sealing a pre-formed bag made of a sealable material and containing a comminuted product. The bag is positioned with its open upper end around a sleeve through which a hollow probe can be extended. A pair of jaw members close to form an outer temporary seal above an intermediate region of the bag above the level of the surface of the product in the bag where a permanent seal is to be formed. A pair of lower jaw members close to form an inner temporary seal about a lower region of the bag above the surface of the product. With the probe extended through the sleeve into the bag, the bag is evacuated through the probe. After evacuation is completed and the probe is withdrawn, a pair of sealing members close against the intermediate region of the bag in order to form a permanent seal for the bag.

Similarly, published U.S. patent application 2002/0023410 to Seaward et al. teaches an apparatus and method for sealing a pre-formed bag made of a sealable material and containing a flowable product. The bag is positioned with its open upper end around a sleeve through which a hollow probe can be extended. A pair of upper jaw members close to form an outer temporary seal about an upper region of the bag above the level of the surface of the product in the bag. A pair of lower jaw members close to form an inner temporary seal about a lower region of the bag below the upper and intermediate regions and above the surface of the product. The hollow probe is used to evacuate the bag, and after evacuation is completed and the probe is withdrawn, a pair of sealing members close against the intermediate region of the bag to form a permanent seal. The method further teaches bleeding back a small amount of a desirable material, which may be an inert gas.

European patent application 381 400 teaches a form-fill-seal machine having a constraint chute below the heat sealing jaws of the machine. The constraint chute includes two vertical walls, one of the walls being adapted to move away from the other wall under tension and to return to its original position, the degree of tension and the friction of the walls is sufficient to squeeze the pouch, while permitting the pouch to travel therebetween. The plane of both of the walls is perpendicular to the direction of the closing jaws. This patent teaches sealing the tubular film below the material/air interface when pouches are completely filled (no "headspace").

U.S. Pat. No. 4,964,259 to Ylvisaker et al. teaches a method of deflating a package of solid goods prior to the time the fill opening is sealed that includes a blast of air against the exterior flexible sidewalls of the package to thereby drive gas from the inside of the package. The blast of air impinges above the upper level of the goods and ceases upon the engagement of the sealing jaws.

U.S. Pat. No. 5,231,817 to Sadler teaches a vertical form-fill-seal machine for making material-filled, slack pouches filled with flowable material, having little or no headspace in the pouches. One jaw of the heat sealing assembly has a jaw wall convex about a vertical axis and located below the heat sealing element. The opposite jaw of the assembly has a jaw wall of an elastomeric sheet stretched under tension and adapted to cooperate with the convex jaw wall. During operation, the jaw walls bias against the material-filled pouch causing air to be expelled from the material and collapsing the tube as the jaws are closed. While this system represents an improvement in the art, there remains a need for a process and apparatus for forming minimal headspace pouches via the vertical form-fill-seal method.

It is an object of the present invention to obviate or mitigate at least one of the above-mentioned disadvantages of the prior art.

SUMMARY OF THE INVENTION

Accordingly, in one aspect, the present invention provides a process for forming a pouch having an evacuated headspace containing a flowable material. The process comprises the steps of: providing a continuous tube of flexible and sealable film; supplying the continuous tube with a predetermined amount of flowable material; pinching the continuous tube above a sealing region so as to form a pinched portion of the continuous tube; evacuating the headspace between the pinched portion and the predetermined amount of flowable material; and sealing the continuous tube at the sealing region to form a top seal of a previously formed pouch containing flowable material and a bottom seal of a next-to-be filled pouch.

In another aspect, the present invention provides a pouch formed by the process of the invention. In yet another aspect, the present invention provides a package, which comprises a pouch of the present invention inside a secondary container.

In yet another aspect, the present invention provides a vertical form-fill-seal apparatus for forming a pouch containing a flowable material and having an evacuated headspace. The apparatus comprises: a tube forming section for forming a vertical continuous tube from a roll of film; a horizontal sealing section for forming a transverse seal across the vertical continuous tube; a filling station for supplying a predetermined amount of flowable material to the vertical continuous tube; pinchers for transversely pinching the vertical continuous tube to form a pinched portion of the continuous tube; an evacuating passage between the pinchers that opens onto the headspace between the predetermined amount of flowable material and the pinched portion; and a deflating apparatus for evacuating the headspace via the evacuating passage.

BRIEF DESCRIPTION OF THE DRAWINGS

Embodiments of the present invention will be described with reference to the accompanying drawings, wherein like reference numerals denote like parts, and in which.

DETAILED DESCRIPTION OF THE PREFERRED EMBODIMENTS

As explained above, the process of the present invention involves forming a continuous film tube into sealed pouches. Typically, the steps of forming the continuous film tube, forming a first seal in the continuous film tube, filling the continuous tube with product, and forming a second seal above the product, thereby yielding a closed filled pouch, will be performed on a single machine of the vertical form-fill-seal type. The continuous film tube is formed of a flexible film, of the type known by those of skill in the art.

While the volumes of pouches according to the present invention are not particularly restricted, suitable pouch volume ranges are from about 1 litre to 12 litres, and more suitably 3 litres to 5 litres. The volume of product contained in the pouch will depend on the volume of the pouch. Where the terms "minimal headspace" or "evacuated headspace" are used in this application, it will be understood that these are relative to standard pouches formed by the standard form-fill-seal process. Preferably, the headspace of pouches of the present invention is reduced by the process of the present invention to a volume of 4 percent or less by volume of the pouch.

Materials suitable for forming the pouch of the present invention are well known to those of skill in the art. Generally the pouch should be sealable and have suitable properties (i.e. strength, flexibility) for carrying the desired product therein.

The pouch of the present invention comprises any suitable plastic film material, such as linear low-density polyethylene, for example. The pouch may comprise multiple plies. An outer ply may be a barrier lamination including a layer made from a foil material or a suitable metallized substrate, or any other recognized flexible barrier or substrate materials including non-metallized materials. An outer barrier lamination suitably comprises an outer layer of nylon, an intermediate layer or foil, and an inner layer of polyethylene. Alternatively, the barrier lamination could comprise an outer layer of polyethylene, an intermediate layer of metallized Nylon, or metallized polyester, or metallized polyvinyl alcohol, and an inner layer of polyethylene.

Other alternate intermediate layers having suitable barrier characteristics include unmetalized polyvinyl alcohol, unmetalized ethyl vinyl alcohol, and metallized ethyl vinyl alcohol.

In any event, all of the materials are selected such that they can be sealed together, giving due consideration to the product to be packaged. Preferably, the lines of seals extend through the entire side walls, including all plies thereof, to form a secure pouch seal.

Figure 1:
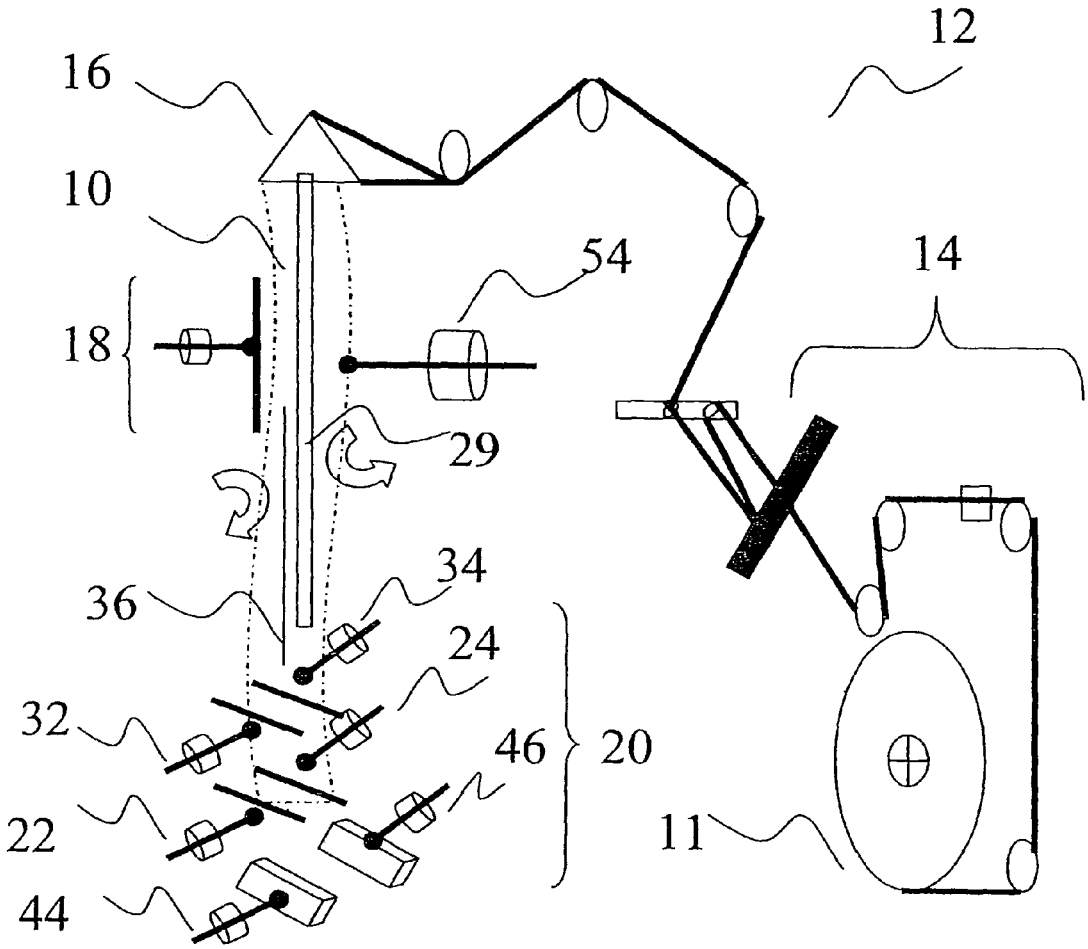
FIG. 1 illustrates a schematic view of an apparatus of the present invention.
Figure 2:
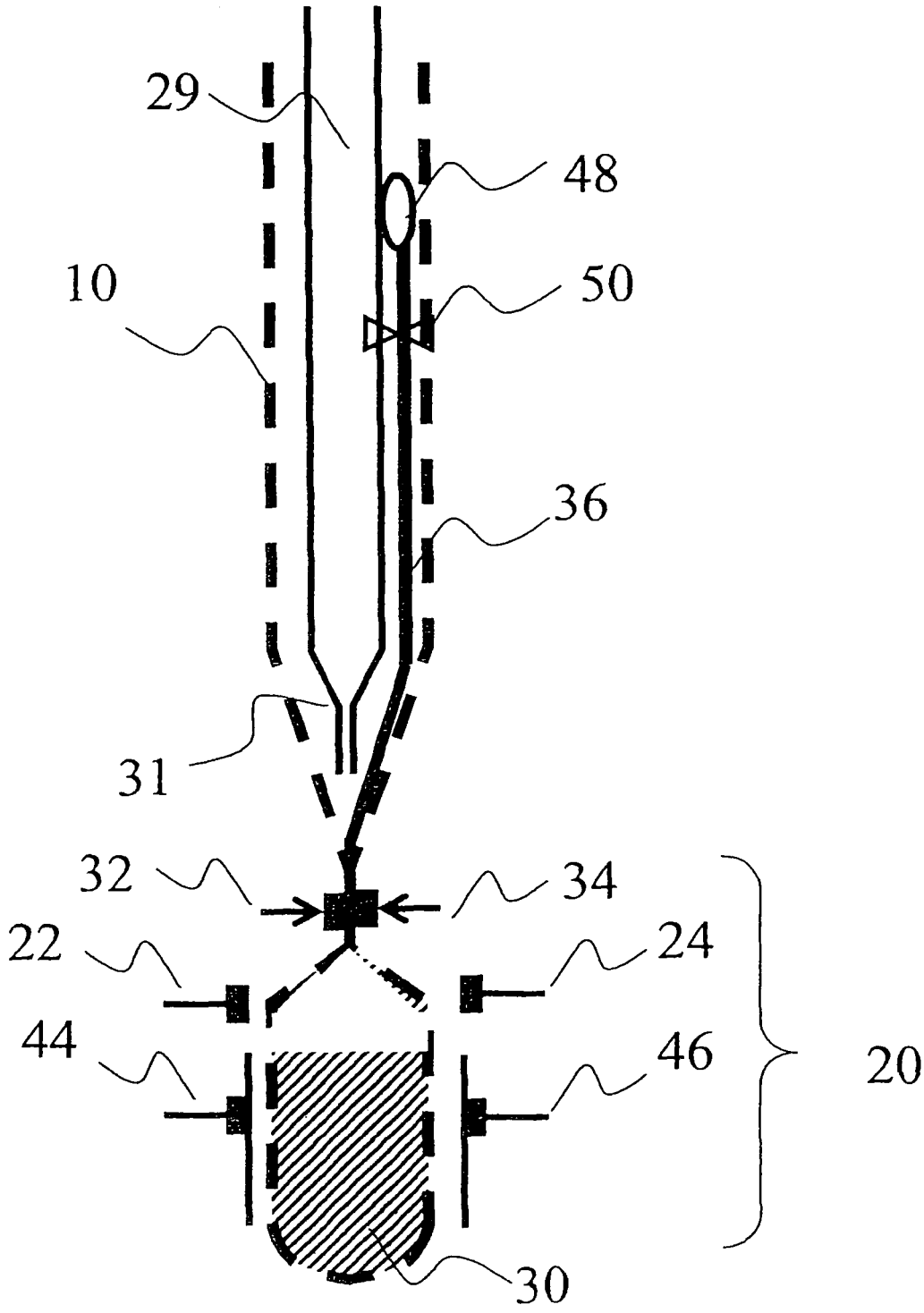
FIG. 2 illustrates a partial front schematic view of an embodiment of the apparatus with closed pinchers and a partially formed pouch of the present invention.
Figure 3:
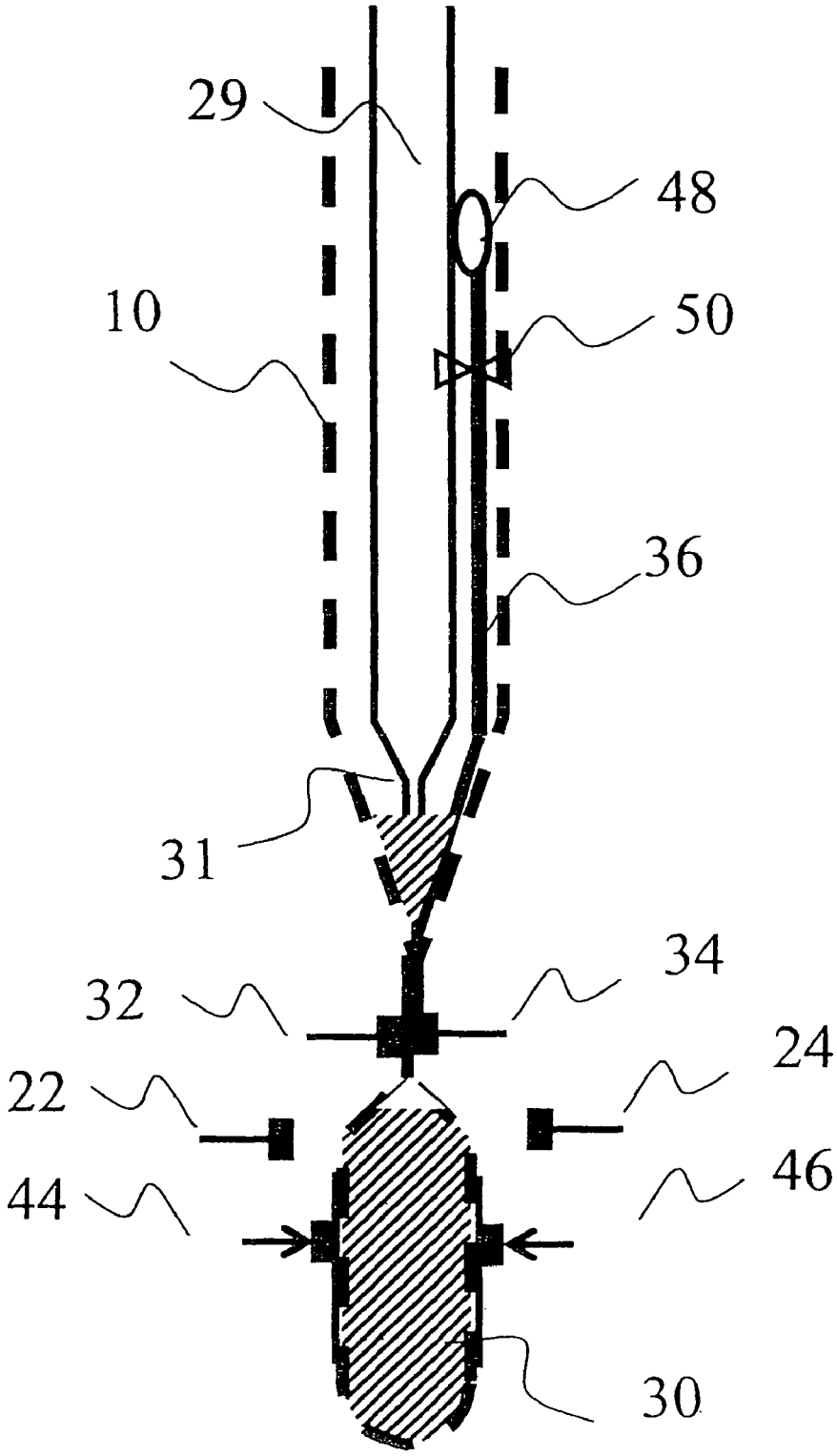
FIG. 3 illustrates a partial front schematic view of an embodiment of the apparatus with activated deflators and a partially formed pouch of the present invention.

Turning to FIG. 1, there is shown a continuous film tube 10 formed from a roll of film 11 using a vertical form-fill-seal machine 12 that includes a roll unwind 14; a forming section 16 where the film folds itself vertically; and a vertical sealing section 18 where the longitudinal edges of the film are sealed together to form a vertical seal, typically a "lap seal" or a "fin seal" (although the type of vertical seal is not particularly restricted and is within the purview of a person skilled in the art.). Suitable vertical sealing jaws could be thermic (constantly heated jaw) or impulse (intermittently powered for each seal). The form-fill-seal machine 12 further includes a horizontal sealing section 20, where a transverse heat seal is made. Typically the transverse heat seal will be formed by a pair of sealing jaws 22, 24, although as will be understood by a person skilled in the art, other sealing arrangements may be possible, although for the purposes of this description, horizontal sealing will be described in terms of sealing jaws 22, 24. Typically, the sealing jaws 22, 24 are also associated with a cutting apparatus (not shown) for severing a formed and filled pouch from the next pouch. The machine 12 may include spreader fingers 26, 28 (see e.g. FIGS. 7, 8, 13 and 14) adapted to be inside the continuous film tube 10 and to shape the tubular film thereof towards a layflat configuration, such layflat configuration having longitudinal edges, thus spreading the longitudinal edges of the continuous film tube 10 outwardly.

The apparatus of the present invention further comprises a filling station typically comprising a product balance tank (not shown) and a supply conduit 29 above horizontal sealing section 20.

After making the horizontal seal, but before the sealing jaws 22, 24 are opened, a quantity of product is supplied to the continuous film tube 10 via the supply conduit 29, which fills the continuous film tube 10 upwardly from the transverse seal. The continuous film tube 10 is then caused to move downwardly a predetermined distance. This movement may be under the influence of the weight of the material in the continuous film tube 10, or may be caused by pulling or mechanically driving the continuous film tube 10. The sealing jaws 22, 24 are closed again, thus collapsing the continuous film tube 10 at a second position, usually just above the air/product interface. The sealing jaws 22, 24 typically seal and sever the continuous film tube 10, or the tube may be severed subsequently. Suitably, a pouch may be simultaneously heat sealed and severed from a subsequent pouch. Alternatively, the pouch may be sealed and subsequently cut from the subsequent pouch, such as by a knife. Another example for severing pouches formed in this manner could be through the use of a perforated or weakened tear line, which can be produced in any number of known ways. Suitable methods for separating pouches are known to those of skill in the art.

Product suitable for the pouch of the present invention are flowable materials. The term "flowable material" does not include gases, but includes materials which are flowable under gravity, may be pumped or otherwise transported through tubes. Such materials include emulsions, e.g. ice cream mix; soft margarine; food dressings; pastes, etc. meat pastes; peanut butter; preserves, e.g. jams, pie fillings, marmalade, jellies; dough; ground meat, e.g. sausage meat; powders, e.g. gelatine powders; detergents; liquids, e.g. milk, oils; granular solids, e.g. rice, sugar; and mixtures of liquids and solids, e.g. chunky soup, cole slaw, macaroni salad, fruit salad, sliced pickles, cherry pie filling. In one application, the flowable material is a liquid suitable for consumption, for example fruit juice, milk, and wine.

Each pouch formed will contain a predetermined amount of product 30. Supplying each pouch with a predetermined amount of product 30 (shown in FIGS. 2 through 6) can be achieved by accurately metering-in product by methods known in the art for either continuous fill or intermittent fill operations. Suitable methods of metering-in, for example, may employ constant (continuous) flow of product and an accurate sealing sequencing timer or any known dosing method enabling intermittent filling of the product.

With the predetermined amount of product 30 metered-in to the continuous film tube 10, a set of pinchers 32, 34 are closed to ensure product 30 stays inside the continuous film tube 10. In a continuous filling operation, the pinchers 32, 34 also separate product from the next pouch being produced as product constantly pours in. An evacuating passage (described in more detail below) permits evacuation of the headspace through the closed pinchers 32, 34, while preventing flow of product from one pouch to the next. "Passage" refers to a path or route through which air can pass to evacuate the headspace between the pinchers.

Figure 7:
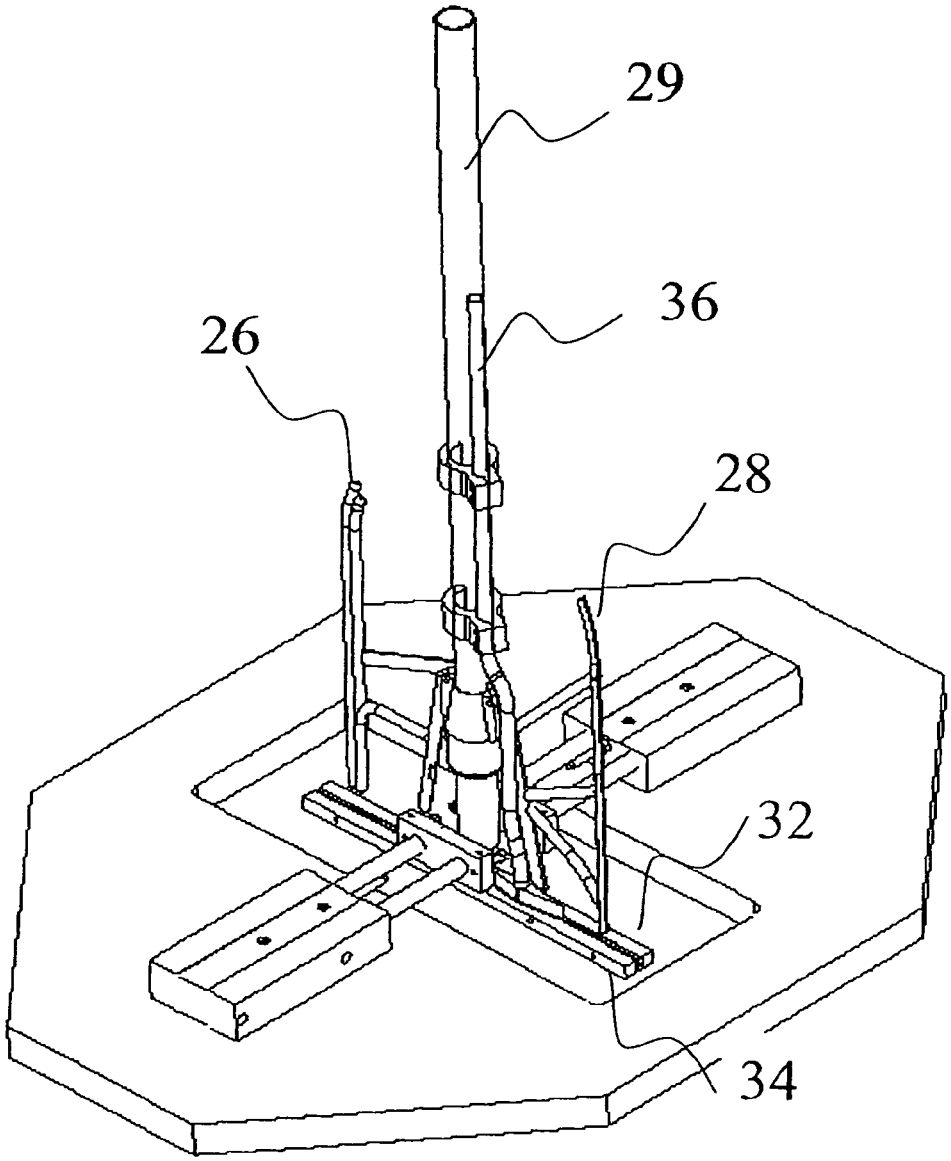
FIG. 7 illustrates a partial perspective view of an embodiment of the apparatus of the present invention, with the pinchers in a closed position.
Figure 8:
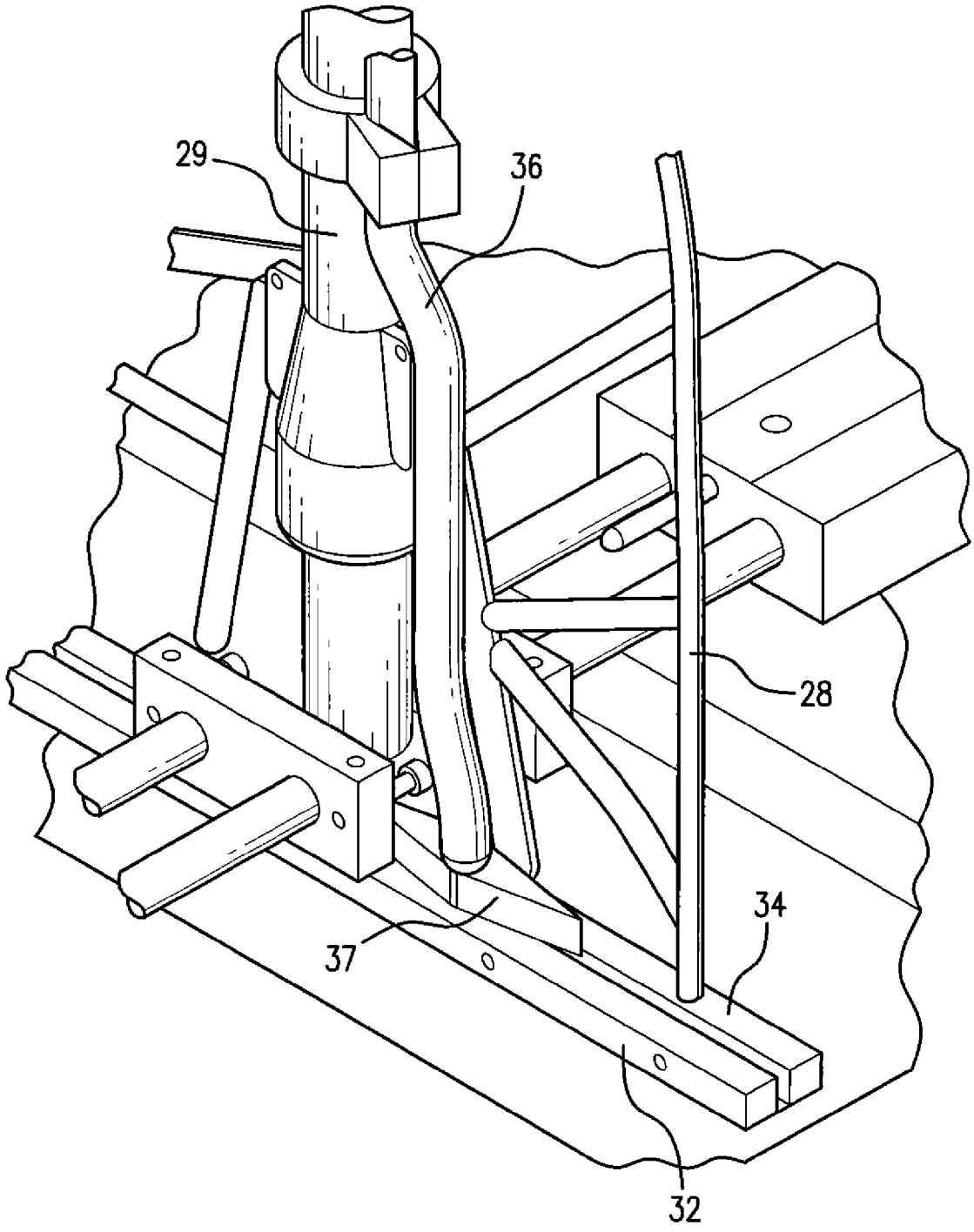
FIG. 8 illustrates a magnified partial perspective view of the pinchers of FIG. 7.

In one embodiment shown in FIGS. 7 and 8, the pinchers 32, 34 are closed against an evacuating tube 36, which acts as the evacuating passage. The pinchers 32, 34 can have a sealing material, such as a rubber ribbon for pinching about the evacuating tube 36. Securely pinching about the evacuating tube 36 so as to minimize product leaks promotes fill accuracy.

Referring to FIGS. 7 and 8, in the embodiment shown, the evacuating tube 36 passes between the pinchers 32, 34 so that its head 37 opens on to the headspace between supplied predetermined amount of product 30 and the pinchers 32, 34. In the vertical form-fill-seal machine 12, the head 37 of evacuating tube 36 may sit at a lower elevation than the pinchers 32, 34, or between pinchers 32, 34 opening on to the headspace. While the term, "head" 37 is used, it will be apparent to a person skilled in the art that the evacuating tube 36 may have a consistent profile along the length thereof. While the shape of the evacuating tube head 37, and the corresponding receiving portion of the pinchers 32, 34 is not particularly restricted, a preferred shape limits tucking and tearing. A preferred shape for the head 37 has been found to be a diamond, as shown in FIG. 8.

In another embodiment of the evacuating passage, the pinchers 32, 34 extend across the width of the continuous film tube 10, but are closed with a force which allows evacuation through the closed faces of the pinchers 32, 34, while limiting product flow. The shape of the faces of the pinchers can facilitate the formation of this type of evacuating passage. The front faces of the pinchers, for example, may suitably have textured or ribbed rubber faces that facilitate the passage of air from the headspace therebetween. While the term evacuating "passage" is used, a person skilled in the art will understand that the invention may include a plurality of small passages through which, collectively, the headspace is evacuated.

Figure 9:
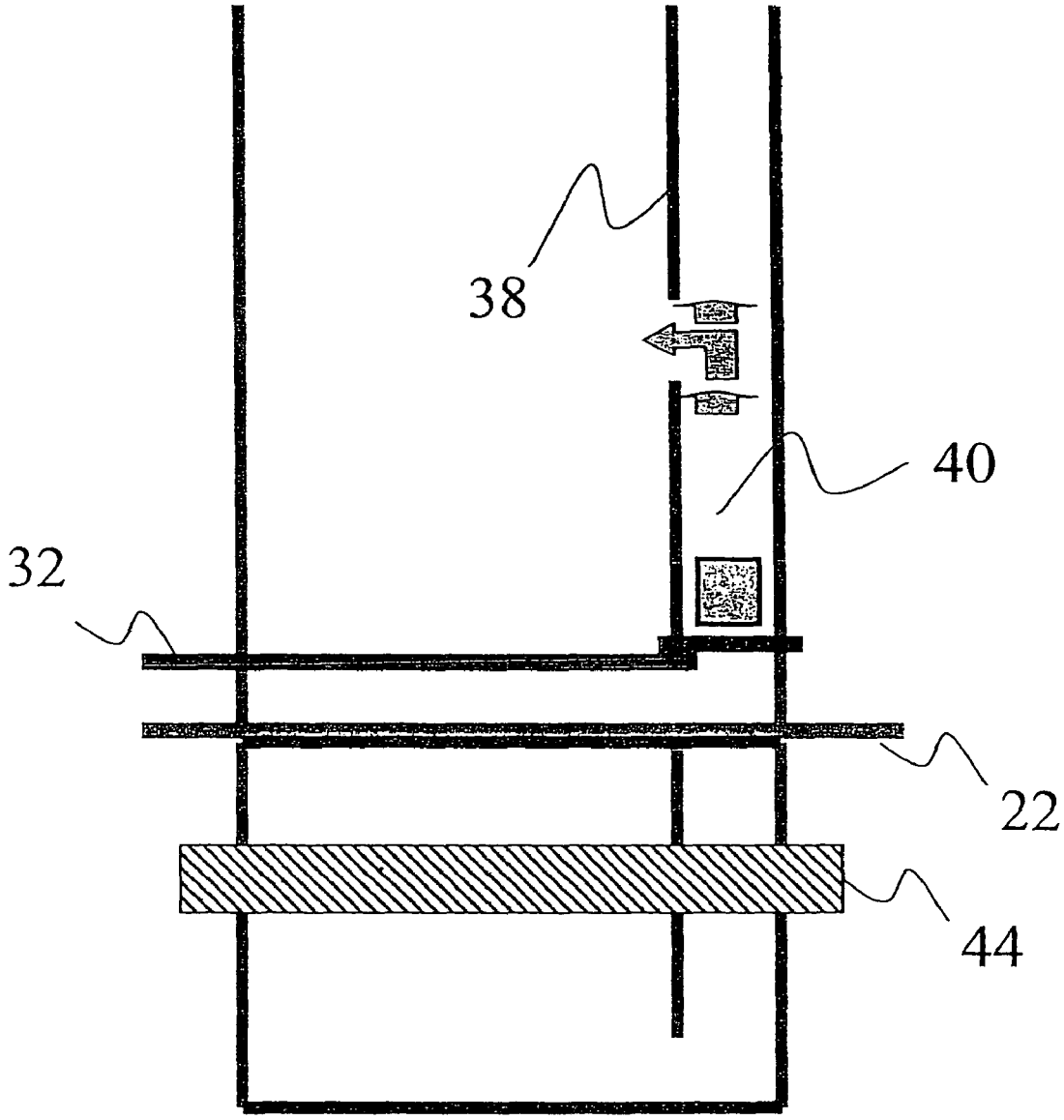
FIG. 9 a front schematic view of an embodiment of the present apparatus, wherein the evacuating passage is formed by an internal vertical seal.
Figure 10:
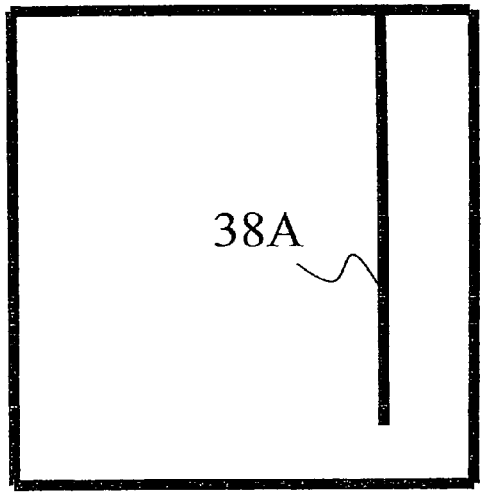
FIG. 10 illustrates illustrates a front schematic view of a pouch suitably formed by the embodiment of the apparatus shown in FIG. 9.
Figure 11:
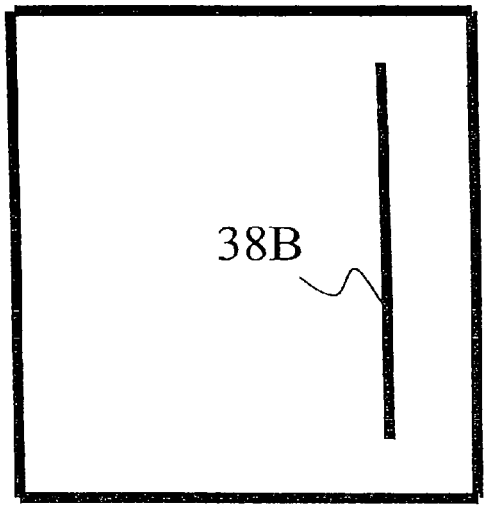
FIG. 11 illustrates a front schematic view of a pouch suitably formed by the embodiment of the apparatus shown in FIG. 9.

In yet another embodiment, shown in FIG. 9, the evacuating passage is formed by forming an additional inner vertical seal 38 which creates a small channel 40 at the side of the pouch, which acts as an evacuating passage allowing evacuation of the headspace. The inner vertical seal 38 is created in such a way as to allow evacuation after the pinchers 32', 34' are closed. The inner vertical seal 38 does not cover the full pouch length. FIGS. 10 and 11, for example, show configurations of two pouches formed according to this embodiment, showing two different inner vertical seals 38A and 38B. In operation, the process is similar to other embodiments of the present invention, although the pinchers 32', 34' do not pinch the full width of the film tube. The channel 40 between the inner vertical seal 38 and the outer vertical seal (or vertical pouch edge seal where an overlap seal is used) allows headspace evacuation from the pouch being formed below the pinchers 32', 34'. The pinchers 32', 34' can be made horizontal or perpendicular to the film path. The pinchers 32', 34' may be sloped upward toward the vertical evacuating film channel 40 to facilitate outflow. As will be recognized by a person skilled in the art, the embodiment has the advantage that there are no additional process lines to clean-in-place.

In yet another embodiment (not shown) rather than a vertical seal 38, a vertical pincher is used in combination with the pinchers 32', 34' which do not pinch the full width of the film tube. The vertical pincher creates a temporary vertical channel for evacuation of the headspace. In essence, the vertical pincher temporarily acts as an inner vertical seal 38 forming an evacuating passage.

Figure 12:
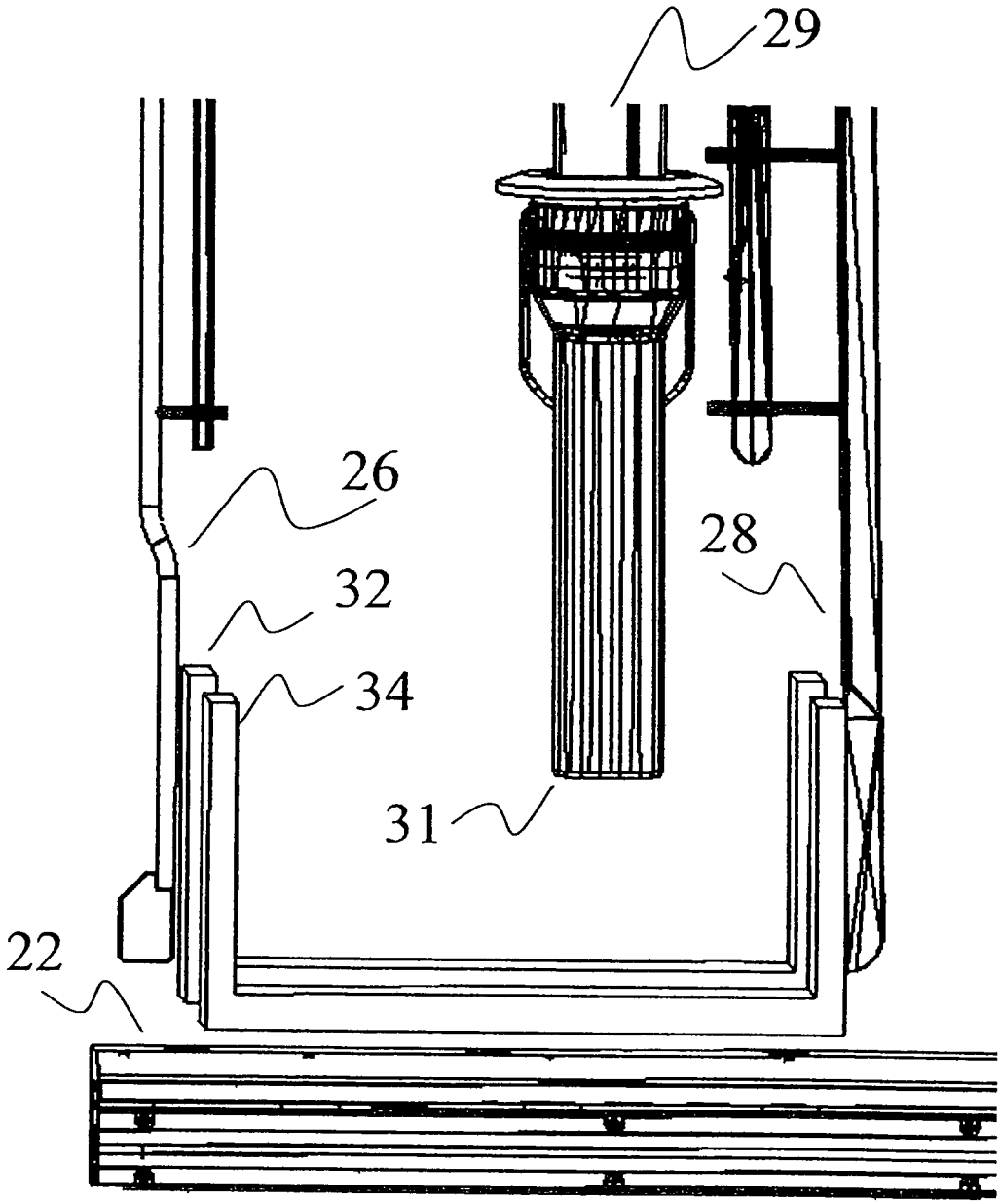
FIG. 12 illustrates a partial front schematic view of an embodiment of the apparatus of the present invention comprising U-shaped pinchers.
Figure 13:
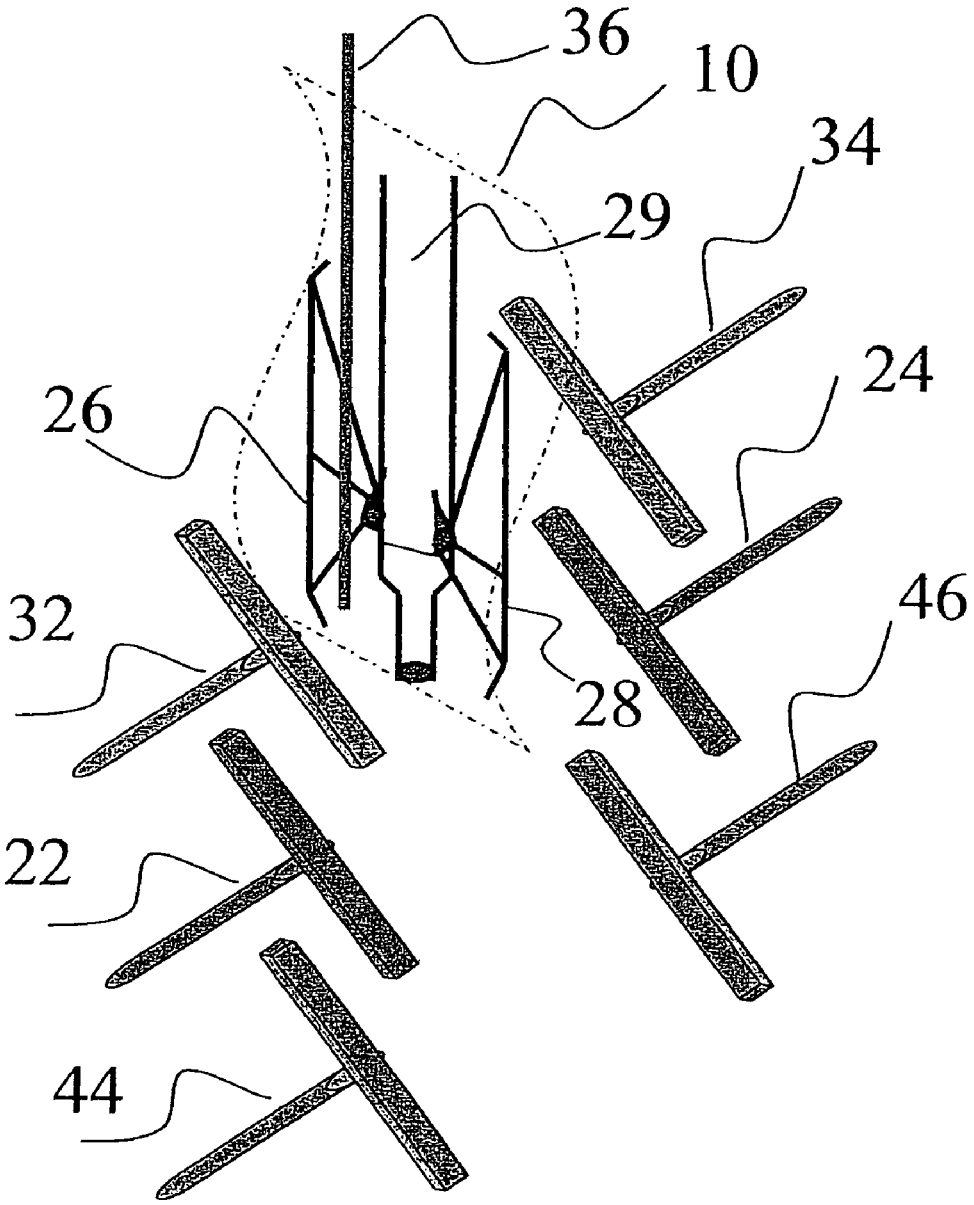
FIG. 13 illustrates a partial schematic perspective view of an embodiment of the apparatus and partly formed pouch of the present invention.
Figure 14:
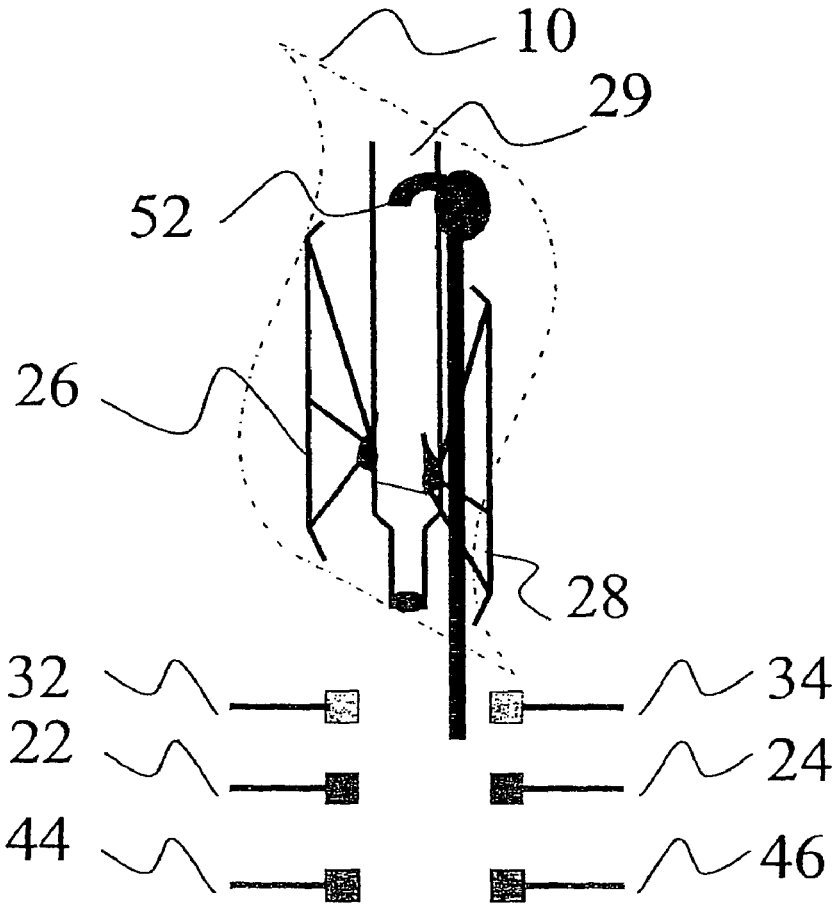
FIG. 14 illustrates a partial schematic perspective view of a further embodiment of the apparatus and partly formed pouch of the present invention, wherein the evacuating tube has a hooked portion.

In another embodiment of the evacuating passage, shown in FIG. 12, a U-shaped pincher 32", 34" is used. The U-shaped pinchers 32", 34" creates two temporary vertical evacuating passages that allow evacuation of the headspace. As will be apparent to a person skilled in the art, other shaped pinchers that form one or more evacuating passages can also be suitable.

In all embodiments, the supply conduit 29 can suitably be attached to a nozzle 31 to facilitate filling of the continuous film tube 10.

Once the pinchers 32, 34 are engaged, a deflating apparatus is employed to evacuate the headspace through the evacuating passage. Suitably, the deflating apparatus comprises a set of deflating jaws or deflators 44, 46. Other deflating apparatuses are known to those of skill in the art; for example, blowers for impinging air blasts or aspiration can be used for deflating. The set of deflators 44, 46 is actuated to push air out to reduce or eliminate headspace. The deflators 44, 46 are suitably located below the sealing jaws 22, 24 and are designed to gently push air out through the evacuating passage until product is coming out and entering the evacuating passage. The particular pressure with which the deflators 44, 46 deflate the headspace will be readily ascertained by a person skilled in the art, and will depend on such variables as the size of the pouch, the machine speed and the properties of the product being packaged. Preferably, the pressure applied is relatively gentle in order to limit build-up of pressure in the system, which may weaken seals. As will be apparent to a person skilled in the art, the deflators 44, 46 could compress all or part of the headspace directly or could compress a portion of the pouch containing the predetermined amount of product 30. Where the evacuating passage is formed by closing of the pinchers 32, 34 with a reduced pressure, the air is pushed out between the pinchers 32, 34, while product flow is prevented. Suitably, the distance of travel of the deflators can be controlled, which enables the production of a consistent volume in the pouch (or shape control). The distance travelled may be controlled by various apparatuses, including e.g. air or hydraulic cylinders or electric actuators.

The deflators 44, 46 are controlled to optimally evacuate the headspace, while limiting evacuation of flowable product. Where an evacuating tube 36 is employed, the deflators 44, 46 are controlled so as to cease evacuating air from the headspace into the evacuating tube 36 once the product starts to flow into the evacuating tube 36. One embodiment of the present invention therefore includes a product sensor 48 (shown in FIGS. 2 through 6) to monitor intake of product by evacuating tube 36 and a control device (not shown) for effecting this step.

Suitable sensors will be known to persons skilled in the art and include, for example, a capacitance probe, an ultrasonic sensor and a light sensor. The product sensor 48 may be mounted inside or outside the evacuating passage, and inside or outside the continuous film tube 10. The present invention provides an accurate method for determining when headspace has been minimized, because once product comes out, essentially all headspace has been eliminated. Further, this method is independent of fill control or reliability. This method is suitable for both continuous or intermittent filling operations.

In an embodiment of the invention, the pressure of the deflators 44, 46 is controlled, in order to control the internal pressure of the pouch formed by the pinching of the continuous film tube 10. The internal pressure will translate to a certain level of product in evacuating tube 36. In this embodiment, a separate product sensor is not necessary in order to ensure fill accuracy (although a sensor can be used if desired.) In this embodiment, the level of product evacuated can be controlled by the timing and pressure of the deflators 44, 46.

Suitably, where an evacuating tube is omitted and the evacuating passage is formed through the pinchers 32, 34. The pressure of the deflators 44, 46 and the timing of the sealing jaws 22, 24 is controlled such that the sealing and cutting operation occurs upon substantial evacuation of the headspace.

Once the headspace has been minimized or eliminated, the pouch is sealed. Generally sealing of the pouch involves transversely heat sealing the continuous film tube 10 to form a top seal of a previously formed pouch containing flowable material and a bottom seal of a next-to-be filled pouch, as is known by persons skilled in the art.

In one embodiment, in order to improve fill accuracy, the product sensor 48 transmits a signal that operates a valve 50 (shown in FIGS. 2 through 6) on the evacuating tube 36, so as to close the valve 50 and thereby to prevent product losses.

In another embodiment, the evacuating tube 36 has a hooked portion 52 (FIG. 14) for feeding evacuated product to the next pouch to be formed.

In yet another embodiment, the evacuating tube 36 is connected to the product balance tank (not shown) to return any evacuated product thereto.

In yet another embodiment, the evacuating tube 36 is connected to an aspirator (not shown) for aspirating air from the headspace. As will be apparent to a person skilled in the art, while the aspirator and evacuating tube 36 can be used in conjunction with deflators 44, 46, the aspirator can be used alone as the deflating apparatus.

The particular arrangement of the deflating apparatus and evacuating tube 36, will depend on a number of factors, including the nature of the product. For example, where relatively high foam products are being packaged, it would be disadvantageous to have the evacuating tube 36 feed evacuated product to the next-to-be formed pouch. Similarly, where a highly viscous product is being packaged it may be beneficial to employ both deflators 44, 46 and an aspirator.

In all embodiments, in order to form the final pouch, the pouch is severed from the next adjacent pouch. As explained above, typically the sealing jaws 22, 24 are associated with a cutting apparatus (not shown) for severing the pouch from the next adjacent pouch. These steps of sealing and cutting can be performed in a simultaneous operation, commonly called a "seal-and-cut operation."

Figure 4:
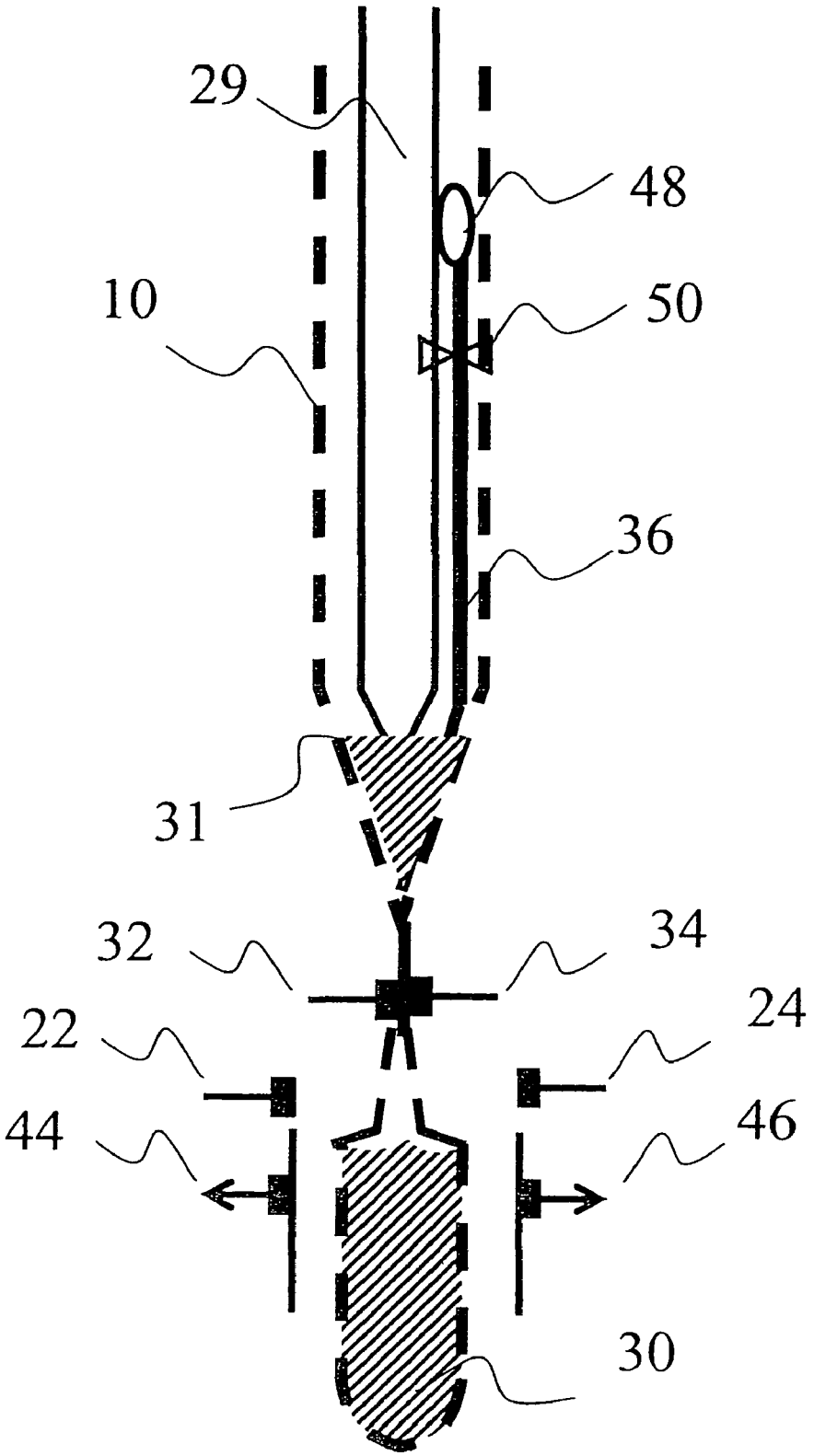
FIG. 4 illustrates a partial front schematic view of an embodiment of the apparatus with the deflators released and a partially formed pouch of the present invention.
Figure 5:
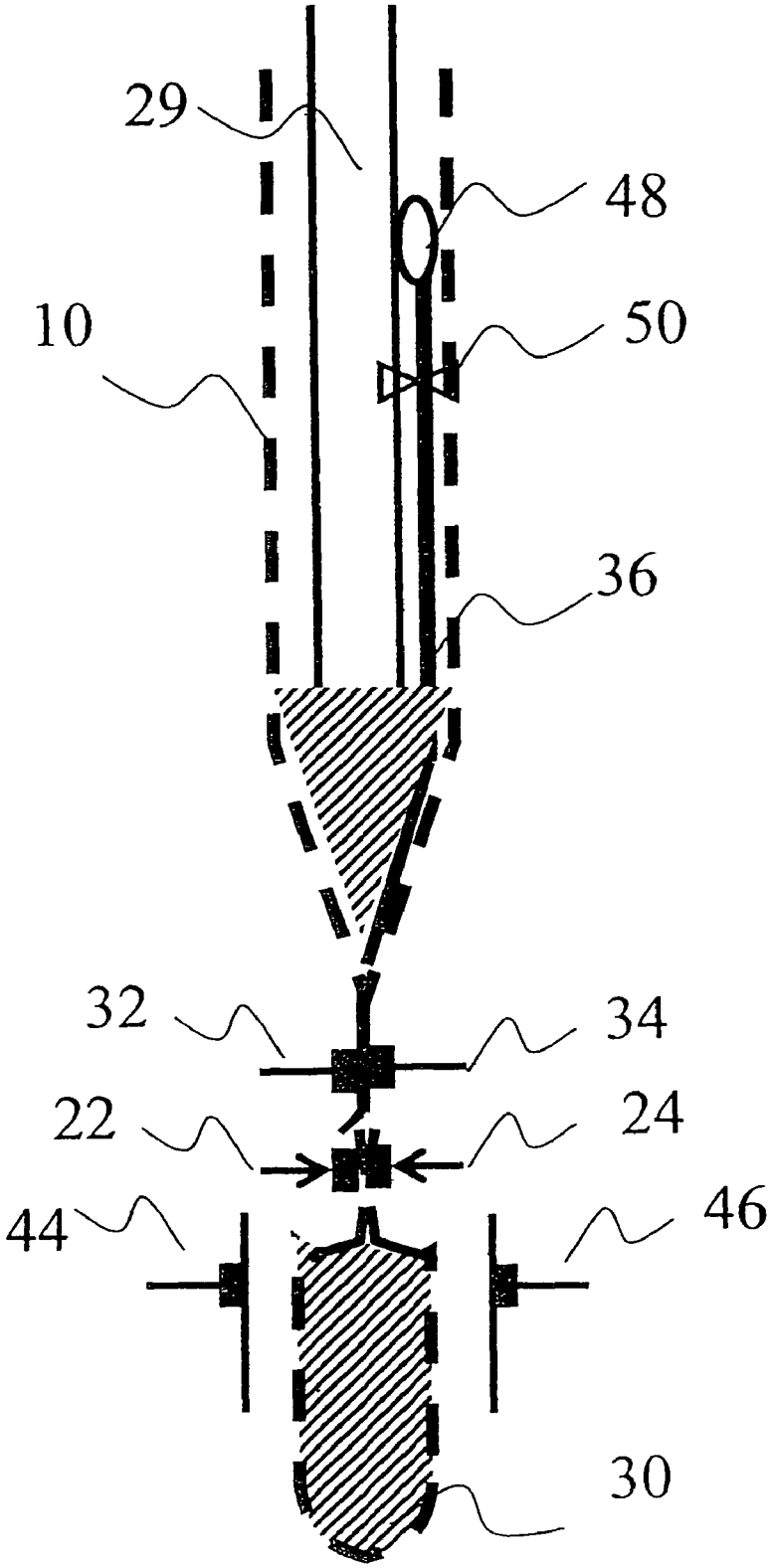
FIG. 5 illustrates a partial front schematic view of an embodiment of the apparatus with the sealing and cutting jaws activated and a partially formed pouch of the present invention.
Figure 6:
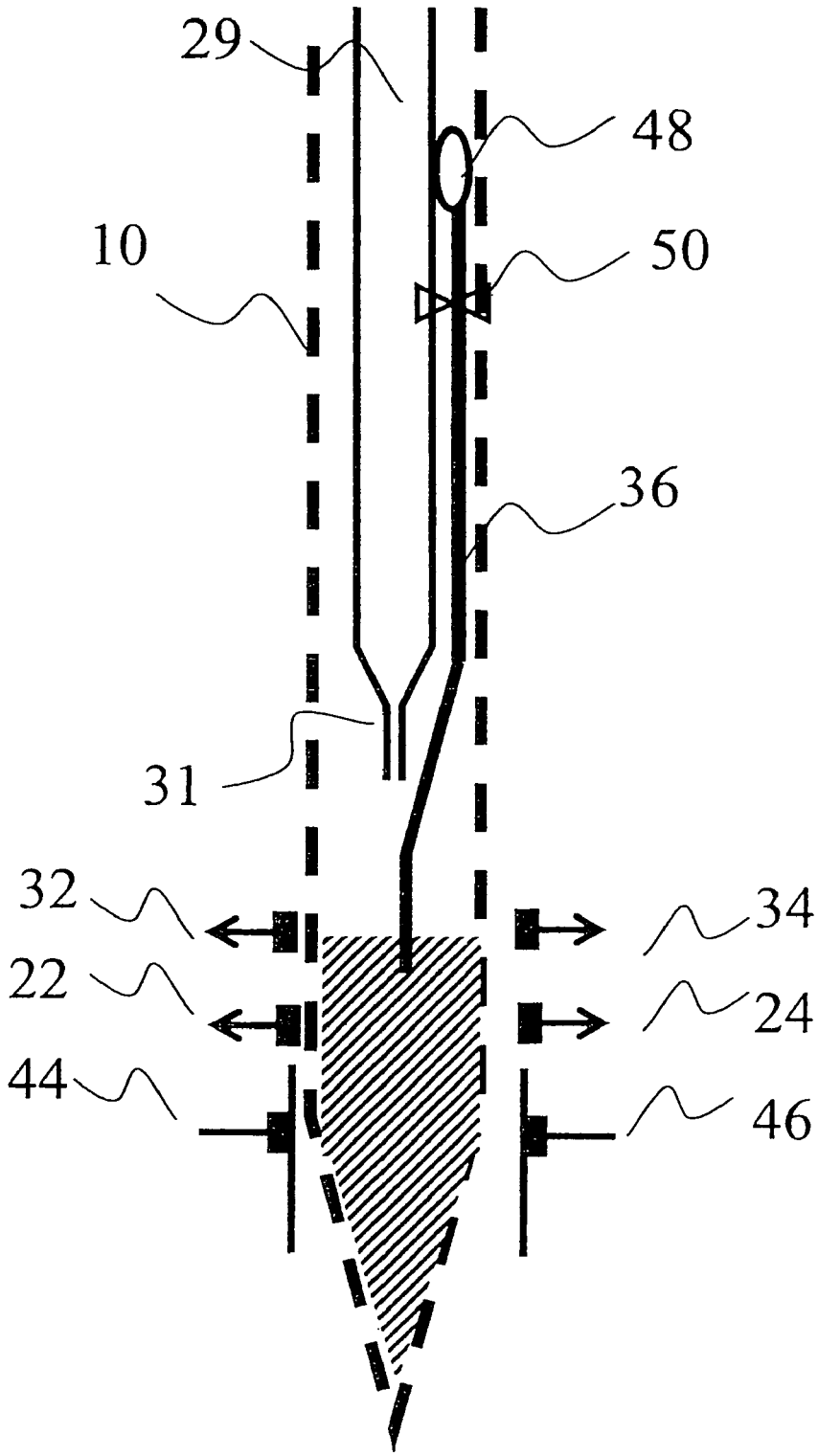
FIG. 6 illustrates a partial front schematic view of an embodiment of the apparatus wherein the sealing jaws, pinchers and deflators are open.

In all embodiments, the deflators 44, 46 suitably may be retracted (as shown in FIG. 4) before sealing the continuous film tube 10, in order to allow draining of the product from the sealing area and to reduce the potential for internal pressure to build up as the sealing jaws 22, 24 come together during sealing.

The process of the present invention can further include additional steps for minimizing product oxidation, examples of which are known in the art. An example of such a technique for minimizing product oxidation is nitrogen displacement (inerting with gaseous nitrogen or liquid nitrogen dosing) to obtain desired headspace oxygen levels. Another technique would be to form the continuous film tube 10 using a film structure with oxygen absorbers incorporated into the structure.

As will be apparent to a person skilled in the art, the minimal headspace itself minimizes product oxidation. In some applications, this can actually enable packaging of an improved product. In the case of wine, for example, sulphites are added as a preservative. The acceptable level of sulphites in wine products is regulated to ensure acceptable levels for consumption. Limiting sulphite levels can improve taste and a low preservative product appeals to consumers. The minimal headspace pouch of the present invention is particularly suitable for packaging a reduced sulphite wine.

As will be apparent to a person skilled in the art, forming a pouch of the present invention may involve additional manufacturing steps (whether prior, during or after the process of the present invention); for example, the pouch may be fitted with a fitment prior to filling (i.e. by way of a fitment application press 54, such as is shown in FIG. 1.) The pouch may also form part of a larger package: for example, it may be inserted into a cardboard box (i.e. according to the "bag-in-box" principle).

While this invention has been described with reference to illustrative embodiments and examples, the description is not intended to be construed in a limiting sense. Thus, various modifications of the illustrative embodiments, as well as other embodiments of the invention, will be apparent to persons skilled in the art upon reference to this description. For example, as will be apparent to persons skilled in the art, while a number of parts are described as being present in the singular or as a pair, there could be two or more of these components present in the apparatus of the present invention, for example, there could be multiple supply conduits, evacuating tubes, deflators, spreader fingers, pinchers, etc. Further, the present invention also encompasses a system for performing the process of the present invention. As will be apparent to a person skilled in the art, while the invention has been described in terms of a single apparatus, the various steps of the process could be performed by different apparatuses that form part of a larger system.

Example 1

Comparative

An Inpaco Mark III machine (Liquid-Box Corporation) was modified to allow continuous flow filling operation. A continuous flow of water was gravity fed from a balance tank to the continuous film tube. A balance tank capacitance level control loop enabled constant flow delivery and an accurate sealing jaw sequenced timer controlled the predetermined amount of water in each pouch. The machine was set to produce 3000 g pouches. Under steady state operation, pouches were collected, weighed and headspace was estimated. The reported fill accuracy (pouch weight standard deviation) was 2 grams with fairly large headspace (greater than 250 cubic centimetres).

Example 2

The machine used in Example 1 was modified according to the present invention to include:

a valved evacuating tube with an evacuating head as shown in FIG. 8 a set of pinchers as shown in FIG. 8.

Similarly, the machine was run under steady state. 7 gram fill accuracy was reported with only 10 cubic centimetres of headspace.

All publications, patents and patent applications referred to herein are incorporated by reference in their entirety to the same extent as if each individual publication, patent or patent application was specifically and individually indicated to be incorporated by reference in its entirety.

LISTING OF PARTS

10 continuous film tube
11 roll of film
12 form-fill-seal machine
14 roll unwind
16 forming section
18 vertical sealing section
20 horizontal sealing section
22, 24 sealing jaws
26, 28 spreader fingers
29 supply conduit
30 a predetermined amount of product
31 nozzle
32, 34 pinchers
36 evacuating tube
37 head of evacuating tube
38 inner vertical seal
40 channel
44, 46 deflators
48 product sensor
50 valve
52 hooked portion of evacuating tube
54 fitment application press

What is claimed is:

1. A process for forming a pouch having an evacuated headspace containing a flowable material comprising the steps of:

providing a continuous tube of flexible and sealable film;

supplying the continuous tube with a predetermined amount of flowable material;

pinching the continuous tube above a sealing region so as to form a pinched portion of the continuous tube including providing an evacuating passage that passes through the pinched portion, said evacuating passage being formed by controlling the force applied to the pinched portion;

transversely compressing the continuous tube beneath the pinched portion with deflating jaws thereby evacuating the headspace between the pinched portion and the predetermined amount of flowable material wherein air from the headspace passes through the pinched portion and flow of flowable material there through is limited;

releasing the deflating jaws after evacuating the headspace before sealing the continuous tube and sealing the continuous tube at the sealing region to form a top seal of a previously formed pouch containing flowable material and a bottom seal of a next-to-be filled pouch.

2. The process of claim 1, wherein the process includes the step of separating the pouch from the next pouch.

3. The process of claim 2, wherein the force of the deflating jaws in compressing the continuous tube beneath the pinched portion is controlled to control the level of flowable material that flows into the evacuating passage.

4. The process of claim 2, wherein the pinched portion extends across only a part of the width of the continuous tube.

5. The process of claim 4, wherein the evacuating passage comprises a channel formed by forming a vertical seal inside the pouch, the channel aligning with the non-pinched part of the width of the continuous tube.

6. The process of claim 5, wherein the step of evacuating the headspace comprises transversely compressing the continuous tube beneath the pinched portion with deflating jaws.

7. The process of claim 6 wherein the deflating jaws are released after evacuating the headspace and before sealing the continuous tube.

8. The process of claim 7, wherein the force of the deflating jaws in compressing the continuous tube beneath the pinched portion is controlled to control the level of flowable material that flows into the evacuating passage.

9. The process of claim 4, wherein the evacuating passage comprises a channel formed by a vertical pincher, the channel aligning with the non-pinched part of the width of the continuous tube.

10. The process of claim 9, wherein the step of evacuating the headspace comprises transversely compressing the continuous tube beneath the pinched portion with deflating jaws.

11. The process of claim 10, wherein the deflating jaws are released after evacuating the headspace and before sealing the continuous tube.

12. The process of claim 11, wherein the force of the deflating jaws in compressing the continuous tube beneath the pinched portion is controlled to control the level of flowable material that flows into the evacuating passage.

13. The process of claim 9, wherein the vertical pincher is part of a U-shaped pincher.

14. The process of claim 13, wherein the step of evacuating the headspace comprises transversely compressing the continuous tube beneath the pinched portion with deflating jaws.

15. The process of claim 14, wherein the deflating jaws are released after evacuating the headspace and before sealing the continuous tube.

16. The process of claim 15 wherein the force of the deflating jaws in compressing the continuous tube beneath the pinched portion is controlled to control the level of flowable material that flows into the evacuating passage.

17. The process of claim 2, wherein the evacuating passage comprises an evacuating tube positioned within the continuous tube and wherein the continuous tube is pinched about the evacuating tube, the evacuating tube having a first end opening onto the headspace.

18. The process of claim 17, wherein the step of evacuating the headspace comprises transversely compressing the continuous tube beneath the pinched portion with deflating jaws.

19. The process of claim 18 wherein the deflating jaws are released after evacuating the headspace and before sealing the continuous tube.

20. The process of claim 19, wherein the force of the deflating jaws in compressing the continuous tube beneath the pinched portion is controlled to control the level of flowable material that flows into the evacuating passage.

21. The process of claim 17 further comprising the step of sensing when flowable material is being evacuated from the continuous tube and ceasing evacuation upon sensing that flowable material is being evacuated.

22. The process of claim 17 wherein the step of evacuating the headspace comprises aspirating the headspace.

23. The process of claim 17 wherein the evacuating tube is valved.

24. The process of claim 17, wherein the evacuating tube has a second end distal the first end, the second end opening into the next pouch to be formed from the continuous tube.

25. The process of claim 2, further comprising the step of forming the continuous tube from a flexible and sealable film by forming the film into a tube by sealing the longitudinal edges of the film using an overlap seal or a fin seal.

26. The process of claim 2, wherein the sealing step and the separating step comprise simultaneous sealing and cutting.

27. The process of claim 26, wherein the simultaneous sealing and cutting is performed by application of heat.

28. The process of claim 2, further comprising the step of injecting an inert gas into the continuous tube or evacuated headspace.

29. The process of claim 28, wherein the inert gas comprises nitrogen.

30. The process of claim 2, wherein the flowable material is supplied continuously.

31. The process of claim 2, wherein the step of supplying the continuous tube with the predetermined amount of flowable material is controlled by a timer.

32. A vertical form-fill-seal apparatus for forming a pouch containing a flowable material and having an evacuated headspace, the apparatus comprising:

a tube forming section for forming a vertical continuous tube from a roll of film;

a horizontal sealing section for forming a transverse seal across the vertical continuous tube;

a filling station for supplying a predetermined amount of flowable material to the vertical continuous tube;

pinchers for transversely pinching the vertical continuous tube to form a pinched portion of the continuous tube;

an evacuating passage between the pinchers that opens onto the headspace between the predetermined amount of flowable material and the pinched portion; and wherein the evacuating passage is formed by controlling the force applied to the pinchers, wherein air from the headspace can pass through the pinched portion and flow of flowable material there through is limited and wherein the evacuating passage comprises an evacuating tube positioned within the vertical continuous tube and wherein the continuous tube is pinched about the evacuating tube, the evacuating tube having a first end opening onto the headspace; and a deflating apparatus for evacuating the headspace via the evacuating passage, wherein the deflating apparatus comprises deflating jaws that apply trans-verse pressure to the vertical continuous tube beneath the pinchers and wherein the deflating jaws are adapted to release prior to activation of the horizontal sealing section.

33. The apparatus of claim 32, further comprising a severing apparatus associated with the horizontal sealing section.

34. The apparatus of claim 32, wherein the transverse pressure is controlled to control the level of flowable material that flows into the evacuating passage.

35. The apparatus of claim 32, further comprising a sensor for sensing the uptake of flowable material into the evacuating tube and a control device for ceasing evacuation of the headspace upon receiving a signal from the sensor.

36. The apparatus of claim 32, wherein the deflating apparatus comprises an aspirator connected to the evacuating tube for aspirating the headspace.

37. The apparatus of claim 32, wherein the pinchers do not extend across the entire width of the continuous tube.

38. The apparatus of claim 37, wherein the apparatus comprises a vertical sealer and the evacuating passage comprises a channel formed by a vertical seal inside the pouch.

39. The apparatus of claim 37, wherein the apparatus comprises a vertical pincher and the evacuating passage comprises a channel formed by the vertical pincher.

40. The apparatus of claim 39, wherein the vertical pincher is part of a U-shaped pincher.

41. The apparatus of claim 32, further comprising spreader fingers.

* * * * *